United States Patent [19]
Benziger
[11] 4,168,191
[45] Sep. 18, 1979

[54] THERMALLY STABLE, PLASTIC-BONDED EXPLOSIVES

[75] Inventor: Theodore M. Benziger, Santa Fe, N. Mex.

[73] Assignee: The United States of America as represented by the United States Department of Energy, Washington, D.C.

[21] Appl. No.: 920,415

[22] Filed: Jun. 29, 1978

[51] Int. Cl.[2] ..... C06B 45/10
[52] U.S. Cl. ..... 149/19.91; 149/92
[58] Field of Search ..... 149/19.9, 19.91, 92; 260/878 B, 886

[56] References Cited

U.S. PATENT DOCUMENTS

| | | | |
|---|---|---|---|
| 3,449,179 | 6/1969 | Minckawa et al. | 149/19.9 |
| 3,528,864 | 9/1970 | Weinland | 149/92 |
| 3,544,360 | 12/1970 | Gardner | 149/92 |
| 3,810,957 | 5/1974 | Luak | 260/878 B |
| 4,090,894 | 5/1978 | Reed et al. | 149/19.91 |

*Primary Examiner*—Edward A. Miller
*Attorney, Agent, or Firm*—Dean E. Carlson; Edward C. Walterscheid

[57] ABSTRACT

By use of an appropriate thermoplastic rubber as the binder, the thermal stability and thermal stress characteristics of plastic-bonded explosives may be greatly improved. In particular, an HMX-based explosive composition using an oil-extended styrene-ethylenebutylene-styrene block copolymer as the binder exhibits high explosive energy and thermal stability and good handling safety and physical properties.

6 Claims, 1 Drawing Figure

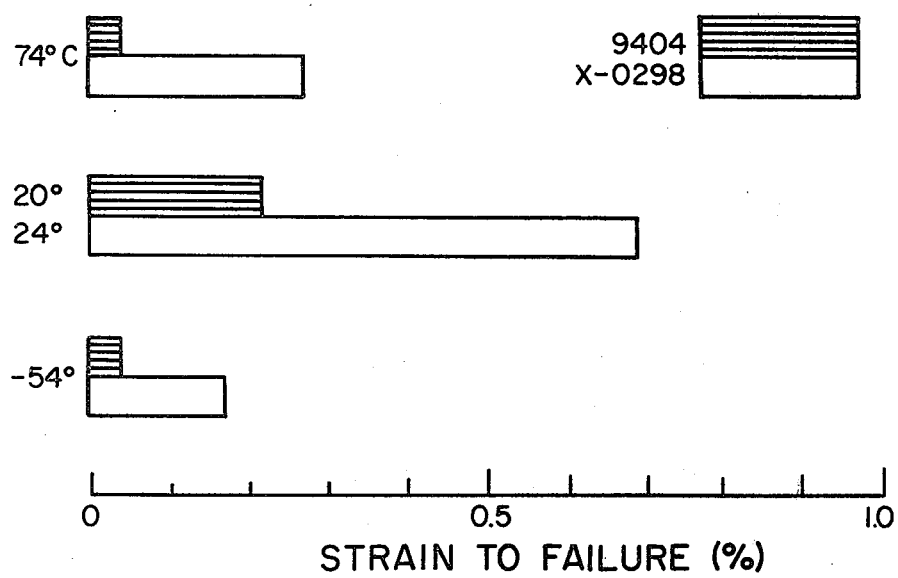
74° C
9404
X-0298
20°
24°
-54°
0
0.5
1.0
STRAIN TO FAILURE (%)
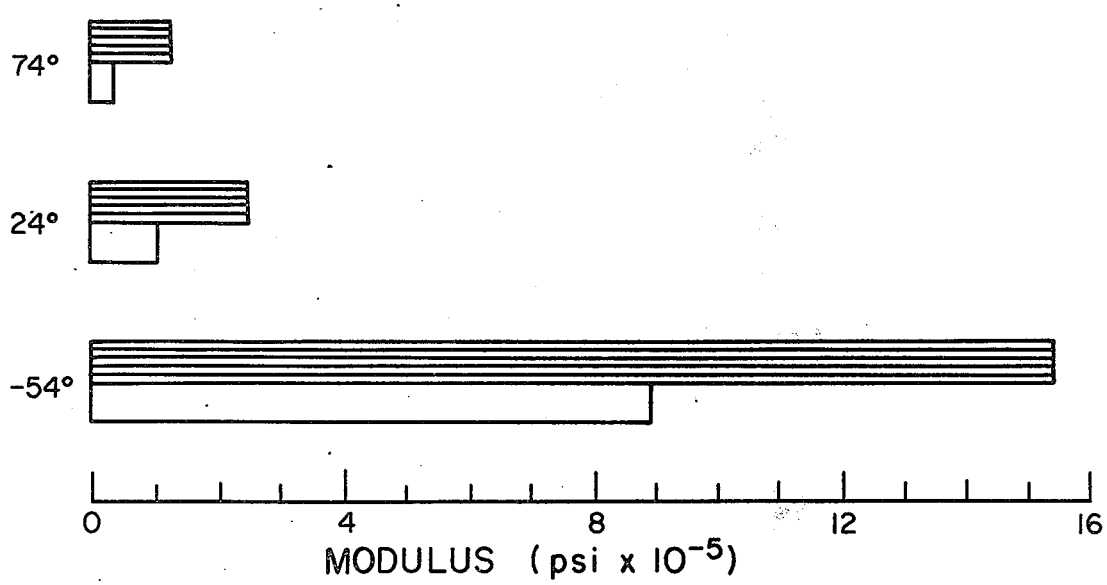
74°
24°
-54°
0
4
8
12
16
MODULUS (psi x 10^-5)

THERMALLY STABLE, PLASTIC-BONDED EXPLOSIVES

BACKGROUND OF THE INVENTION

The invention described herein relates to high explosives and more particularly to thermally-stable, plastic-bonded explosives.

New requirements for high explosives have appeared in many applications of modern ordnance. In particular, there are various modern ordnance applications that require the explosive to see extended service at elevated temperatures. Accordingly, explosive compositions having a reasonable explosive performance and a high degree of thermal stability are desired. Additionally, such a heat-resistant explosive should be capable of being readily formed into the varied shapes required in modern ordnance and should have a sufficient strength to retain its structural integrity under rather severe thermal conditions.

Plastic-bonded explosives represent a class of explosives which can be made into pressings from which can be fabricated—usually by machining—desired shapes. These explosives are pressed from so-called molding powders which are typically prepared by the slurry technique. Powdered explosive and water are mixed in a kettle equipped with a condenser and agitator. A lacquer composed of the plastic (together with a plasticizer, if necessary) dissolved in a suitable solvent is added to the slurry. The solvent is removed by distillation, causing the plastic phase to precipitate out on the explosive. The plastic-explosive agglomerates into "beads" as the stirring and solvent removal continues. Finally, water is removed from the beads by filtration and drying; the resultant product is the molding powder. The powder is then pressed into shape by either compression molding with steel dies or hydrostatic or isostatic pressing under vacuum. The pressing may readily be machined into a desired shape for actual use.

Plastic-bonded, HMX-based explosives normally use energetic binder systems, such as nitroaliphatic compounds or nitrate esters, to maximize their explosive power. High-density, halogenated resins are also used for this purpose. Unfortunately, both of these binder types introduce problems. The thermal stability of energetic binder materials is less than that of the HMX filler. This property limits the service life of the explosive in high temperature applications. Although the halogenated resin binders are thermally stable, they are undesirable in that they cause the explosive to be unduly sensitive in the skid test, an important measure of handling safety.

DEFINITION OF TERMS

As used within this application, HMX is an explosive having the chemical name 1,3,5,7-tetranitro-1,3,5,7-tetraazacyclooctane, also designated as cyclotetramethylene-tetranitramine; Kraton G-6500 is a tradename for a thermoplastic rubber which is a styrene-ethylenebutylene-styrene block copolymer manufactured by Shell Chemical Co.; Hyvac 93-50-3 is a paraffinic oil sold by Central Scientific Co.; TATB is an explosive having the chemical name sym-triamino-trinitrobenzene; RDX is an explosive having the chemical name hexahydro-trinitro-triazine, also known as cyclotrimethylene-trinitramine.

SUMMARY OF THE INVENTION

I have found that plastic-bonded explosives having excellent thermal stability, good handling safety, and good physical properties may readily be produced using as the binder a styrene-ethylenebutylene-styrene block copolymer thermoplastic rubber which is manufactured and sold under the tradename Kraton G-6500. The thermal stress properties of these explosives may be further improved through use of an appropriate extender. A preferred embodiment of my invention is a plastic-bonded explosive containing 97.5 wt % HMX, 1.12 wt % Kraton G-6500, and 1.38 wt % paraffinic oil.

BRIEF DESCRIPTION OF THE DRAWING

The FIGURE is a bar chart comparing the tensile properties of the plastic-bonded explosive which is the preferred embodiment of the invention to that of a standard plastic-bonded explosive, PBX 9404.

DESCRIPTION OF THE PREFERRED EMBODIMENT

Kraton G-6500 is an unusual polymer in that it acts as a cross-linked (vulcanized) rubber at temperatures below the glass point of styrene (100° C.) through an association of the styrene blocks or domains. At higher temperatures, these bonds are broken, and the polymer acts as a thermoplastic in forming operations such as compression molding. It reverts, however, to its original cross-linked structure upon cooling. Certain solvents also weaken these bonds and dissolve the polymer, thus allowing the use of the slurry process with this polymer in the manufacture of plastic-bonded explosives.

The properties of Kraton G-6500 may readily be varied by extending it with a pure paraffinic oil such as Hyvac 93050-3. Such extension, while producing a low modulus and high elasticity, does not destroy the attractive cross-linking feature of the polymer. As indicated by the following data, a binder composed of 45 wt % Kraton G-6500 and 55 wt % pure paraffinic oil has remarkable elasticity while its properties remain relatively constant over a wide temperature range.

Exudation test: none
Elongation, elastic (%): 900
Elongation, break (%): >900
Shore durometer (A-2):
+74° C.: 15
+24° C.: 21
−23° C.: 30
Glass point, $T_G$ (°C.): −63

Kraton G-6500 may be used as a binder in plastic-bonded explosives with a variety of explosive compounds. As will become apparent later in this specification, it is thermally stable and does not degrade even when kept at 90° C. for long periods. Thus, the thermal stability of plastic-bonded explosives using it as a binder is largely predicated on the thermal stability of the explosive compound incorporated therein as the filler. A preferred explosive compound for use with the Kraton G-6500 is HMX which has good thermal stability and excellent explosive characteristics. Examples of other explosive compounds which may readily be used with the Kraton G-6500 binder include RDX and TATB.

Depending on the properties desired, plastic-bonded explosives using Kraton G-6500 as the binder may contain as much as 10 wt % of the binder. As used here, the term "binder" may include the use of certain additives to obtain desired physical properties. A preferred additive to provide low modulus and excellent elasticity is the paraffinic oil extender noted earlier in this specification. Alternatively, a microcrystalline petroleum wax may readily be used as the extender. The extender may be added in any desired ratio, however, when paraffinic oil is used and the fraction of the oil in the binder approaches 65 wt %, the oil begins to exude from the binder.

A preferred embodiment of the plastic-bonded explosive of this invention contains 97.5 wt % HMX, 1.12 wt % Kraton G-6500 and 1.38 wt % paraffinic oil. Hereinafter in this specification this composition will be referred to as X-0298.

As the following data show, X-0298 is quite stable in the conventional short-term tests.

DTA exotherm (°C.): 260

Vacuum stability ($cm^3/g$, 120° C., 48 h): 0.1–0.3

Henkin test: acts as pure HMX

The excellent thermal stability of X-0298 is more fully demonstrated in storage-stability tests made at elevated temperatures. In one set of experiments, small cylinders of X-0298 were stored at 90° C. in sealed ampoules containing an air atmosphere for 34 weeks. Gas evolution for this period amounted to only 0.5 $cm^3/g$. Analysis of the evolved gases ($N_2O$, $CO_2$, CO and $H_2O$) indicated that essentially all decomposition was that of HMX, with the binder remaining unchanged. The inert nature of the binder was also shown by GPC measurements in which the molecular weight of both the Kraton G-6500 and the paraffinic oil binder fractions showed no significant change over the 34-week, 90° C. test period.

Tensile tests were also made on X-0298 specimens that had been held at 60° C. for 16 weeks. Properties, modulus, elongation and strength, were unaffected by this exposure.

The results of these various tests show that the X-0298 system is of extraordinary stability, especially when compared to energetic-binder plastic-bonded explosives of similar explosive performance. There is no filler-binder interaction, and its stability may be considered as that of the HMX alone under the test conditions.

Explosive properties of X-0298 are given in Table I. The explosive performance ($P_{CJ}$) of X-0298, as measured by plate dent and detonation velocity (see Table I), is quite similar to that of standard, high energy explosives, such as PBX 9404 and PBX 9501. Its initiation and propagation characteristics are also similar. Its handling safety is quite acceptable, with a value of 4.2 m (13.8 ft) in the skid test.

The strength properties of X-0298, given in Table II, are generally similar to those of PBX 9404 and PBX 9501. In tension, however, X-0298 differs in having an unusually large strain-to-failure and a low modulus. These features, as illustrated in the FIGURE, reflect the soft, elastic nature of the binder. Such properties, particularly at low temperatures, are desirable in structural applications of explosives that involve a large thermal strain.

TABLE I

| X-0298 Explosive Properties | |
|---|---|
| Density | |
| Theoretical density ($g/cm^3$) | 1.847 |
| Pressed density ($g/cm^3$) | 1.813–1.825 (98.2–98.8% TMD) |
| Powder bulk density ($g/cm^3$) | 0.98 |

TABLE I-continued

| X-0298 Explosive Properties | |
|---|---|
| Performance | |
| Detonation velocity (m/s) | 8833 (1.817 $g/cm^3$) |
| Calculated $P_{CJ}$ (kb) | 366 (1.817 $g/cm^3$) |
| Plate Dent $P_{CJ}$ (kb) | 363 (1.817 $g/cm^3$) |
| Sensitivity | |
| Drop-weight impact, 12/12 B (cm) | 47/54 |
| Skid test, 45° (m) | 4.2 (13.8 ft) low partials |
| Gap test small scale (mm) | 1.65, brass (1.818 $g/cm^3$) |
| Gap test, standard (mm) | 52.76, aluinum (1.815 $g/cm^3$) |
| Minimum priming (g Extex) | 0.026 |
| Spark (J) | 0.5 (0108 mm foil)<br>3.9 (0.25 mm foil), |
| Friction | no reaction, 45° at 100 cm drop |
| Machining | satisfactory |
| Wedge failure (mm) | 0.47 |

TABLE II

| Strength Properties of X-0298 | | | | |
|---|---|---|---|---|
| Tensile | Prop Limit (psi) | Ultimate (psi) | Modulus (psi × $10^{-5}$) | Elongation (%) |
| +74° C. | 18 | 51 | 0.33 | 0.27 |
| +24° | 32 | 215 | 1.09 | 0.69 |
| −54 | 228 | 683 | 8.91 | 0.17 |
| Compression | | | | |
| +74° | 391 | 447 | 0.41 | |
| +24° | 1518 | 2068 | 1.53 | |
| −54 | 2525 | 4059 | 2.90 | |
| Shear | | | | |
| +74° | 351 | 418 | | |
| +24° | −828 | 930 | | |
| −54 | 1605 | 1878 | | |
| Creep | | | | |
| Deflection, 100 psi, 60° C., 25 h (%) | | | | 0.30 |
| Thermal Expansion | | | | |
| C.T.E., −54 to +74° C. (°C.$^{-1}$ × $10^6$ | | | | 48.4 |

To prepare X-0298, a slurry of 12.68 kg of Class A HMX (coarse) and 6.82 kg of Class B (five) HMX in 80 liters of water is prepared in an agitated, heated vessel. A lacquer consisting of 224 g of Kraton G-6500, 276 g of paraffinic oil (Hyvac 93050-3), and 2.4 liters of n-butylacetate solvent is added to the vessel, which is at 75° C. With strong agitation, the temperature is raised to 80°–83° C. The agitation is then reduced to a low level, and heat is applied to drive off the solvent by azeotropic distillation. Cooling is then applied, and the coated agglomerated HMX particles are recovered by filtration. After drying in trays in a forced-draft oven, the 20 kg of product is suitable for use as a molding powder in the formation of desired explosive shapes.

The foregoing description of X-0298 and the means of making it are supplied to comply with the best mode requirement of 35 U.S.C. 112. The invention is not in any way limited to this preferred embodiment but rather is as set forth in the Summary of the Invention and encompassed by the broad claims appended hereto.

What I claim is:

1. In a plastic-bonded explosive which comprises an explosive compound filler and a plastic binder in a desired ratio, the improvement comprising use of a thermoplastic rubber which is a styrene-ethylenebutylene-styrene block copolymer as the plastic binder.

2. The plastic-bonded explosive of claim 1 wherein said thermoplastic rubber binder has an extender incorporated therein in a desired ratio.

3. The plastic-bonded explosive of claims 1 or 2 wherein said explosive compound is cyclotetramethylene-tetranitramine, cyclotrimethylene-trinitramine, or sym-triamino-trinitrobenzene.

4. The plastic-bonded explosive of claim 2 wherein said explosive compound is cyclotetramethylene-tetranitramine and said extender is paraffinic oil.

5. The plastic-bonded explosive of claim 4 containing 97.5 wt % cyclotetramethylene-tetranitramine, 1.12 wt % of said thermoplastic rubber, and 1.38 wt % paraffinic oil.

6. A plastic-bonded explosive having excellent thermal stability which comprises in a desired ratio (a) cyclotetramethylene-tetranitramine, cyclotrimethylene-trinitramine, or sym-triamino-trinitrobenzene, (b) a styrene-ethylenebutylene-styrene block copolymer thermoplastic rubber, and (c) paraffinic oil or a microcrystalline petroleum wax.

* * * * *